United States Patent [19]

Kelly et al.

[11] Patent Number: 4,898,391

[45] Date of Patent: Feb. 6, 1990

[54] TARGET SHOOTING GAME

[75] Inventors: Bryan M. Kelly; Jorge M. Fernandes; Matthew F. Kelly, all of Pleasanton; Mark R. Kelly, Danville, all of Calif.

[73] Assignee: Lazer-Tron Company, Pleasanton, Calif.

[21] Appl. No.: 270,262

[22] Filed: Nov. 14, 1988

[51] Int. Cl.[4] ..... F41J 5/02

[52] U.S. Cl. ..... 273/310; 434/22

[58] Field of Search ..... 273/310–312; 434/21, 22

[56] References Cited

U.S. PATENT DOCUMENTS 4,487,583 12/1984 Brucker et al. ..... 434/22

4,662,845 5/1987 Gallagher et al. ..... 434/22

*Primary Examiner*—Edwarad M. Coven

*Assistant Examiner*—Benjamin Layno

*Attorney, Agent, or Firm*—Robert R. Tipton

[57] ABSTRACT

A target shooting apparatus utilizes a plurality of light beam emitting guns or rifles to shoot at a plurality of targets, the individual light beam guns being identified by frequency encoding the light beam emitted by each rifle. The first rifle to "hit" a target deactivates the target and is credited with a score. Light and sound effects are generated when a target is "hit" to simulate reality. The number of rifles and targets is limited only by the physical size of the apparatus that would be practical to accommodate the players.

7 Claims, 4 Drawing Sheets

TARGET SHOOTING GAME

BACKGROUND OF THE PRIOR ART

This invention relates generally to target shooting games and in particular to target shooting games employing guns or rifles utilizing a light beam.

Most of the target shooting games of the prior art utilized a light beam adapted to activate a photodetector either at the target or at the light emitting gun or rifle.

In one such apparatus, a multi-target shooting game utilized a plurality of targets in the form of light sensitive cells in close proximity to light emitting diodes. The target was activated by energizing the light emitting diode for a short period of time requiring the shooter to respond quickly, aim and fire in different directions as the different targets became active. The apparatus permitted only one player or shooter at a time to play.

In another prior art device a toy light emitting gun was used to shoot a pulse of light at a reflecting target. The reflected light was detected by a photodetector located in the toy gun. The apparatus did not distinguish which target had been hit. A sound effect was created when the photodetector in the gun detected a reflected beam of light.

A further shooting game utilized two players using light beam emitting guns to fire at photodetector targets located at each player's station.

One multiple player shooting apparatus utilized light beam emitting guns or rifles in which the various rifles were enabled sequentially in order to identify the rifle being fired. A multiplexer was provided for sequentially connecting a score display with each rifle. The multiplexer enabled the rifle only during the unique time period the associated rifle score display was connected to the targets. The enabling feature prevented any accurate determination of who hit the target first. The number of rifles that could be used at one time was limited by the time delay of the multiplexer.

SUMMARY OF THE INVENTION

The shooting apparatus of the present invention operates in a real time mode with all light beam guns being activated concurrently and continuously.

It comprises, basically, a plurality of light beam emitting guns or rifles each of which is adapted to generate one or more beams of light with one light beam being amplitude or pulse modulated at one or more unique frequencies of combinations of frequencies.

The apparatus of the present invention further comprises a plurality of targets, each target comprising, basically, a photodetector adapted to detect the frequency encoded beam of light, and analog-to-digital converter or decoder for decoding the frequency encoded light beam signal, a target first light source adapted to indicate an active target and a target second light source adapted to provide a visual display to indicate a "hit" by one of the light beam guns.

Means are also provided to sequentially deactivate the target first light source, activate the target second light source, decode the frequency encoded light beam signal, allocate a score to the rifle represented by the decoded signal, and deactivate the means for detecting the frequency encoded beam when an encoded light beam is detected by the means for detecting the frequency encoded beam.

The apparatus also includes means for generating general background sound effects when a game is in progress as well as special sound effects when a target has been hit.

It is, therefore, an object of the present invention to provide a target shooting apparatus utilizing a plurality of light beam emitting guns or rifles for shooting at a plurality of individual targets.

It is a further object of the present invention to provide a target shooting apparatus utilizing light beam emitting guns or rifles in which one of the light beams for each rifle is frequency encoded with a unique frequency or combination of frequencies.

It is yet another object of the present invention to provide a target shooting apparatus in which the target is deactivated after a frequency encoded beam of light from a light beam gun or rifle has been detected at a particular target.

It is still another object of the present invention to provide a target shooting apparatus in which a visual and sound effects display is activated when a frequency encoded beam of light from a rifle has been detected at a particular target.

These and other objects of the present invention will become manifest up study of the following specification when taken together with the drawings.

DESCRIPTION OF THE PREFERRED EMBODIMENT

Figure 1:
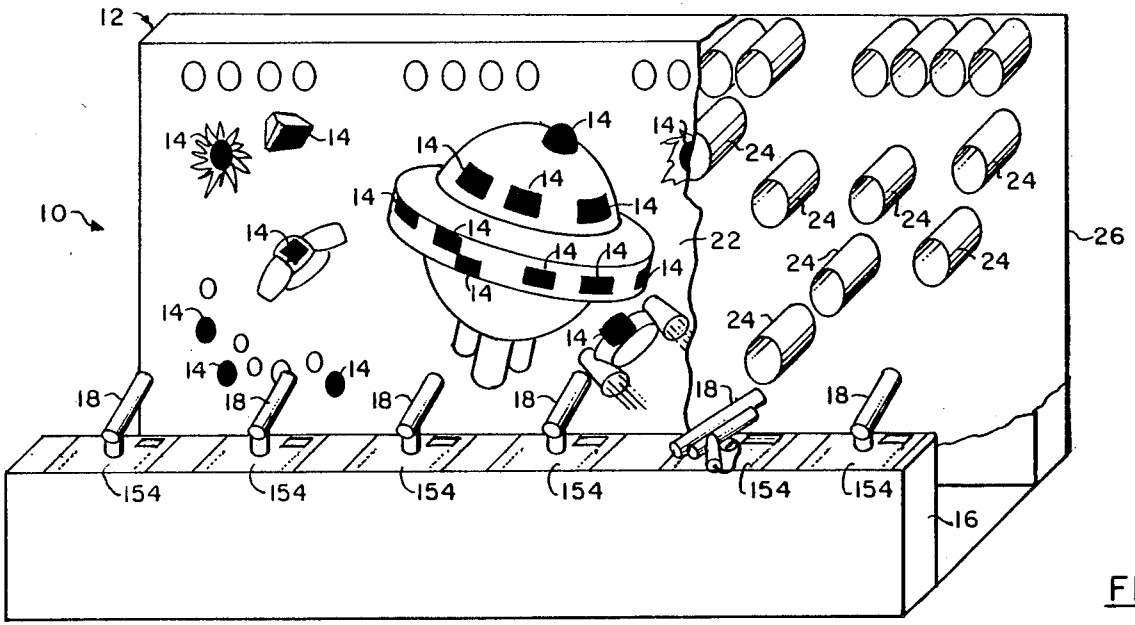
FIG. 1 is an isometric, partial cut-away view of the target shooting apparatus of the present invention.

With reference to FIG. 1 there is illustrated an isometric elevational view of the target shooting apparatus 10 of the present invention comprising, basically, a target panel display 12 containing a plurality of targets 14, and a player or shooter's stand 16 containing a plurality of target light beam guns or rifles 18.

When actuated by a player, target light beam guns or rifles 18 are adapted to create a frequency encoded light beam 68 (shown in greater detail in FIG. 5) unique to each rifle.

Target panel display 12 comprises a transparent or semi-transparent front panel 22 on which is painted, using opaque paint, artwork depicting various objects according to the theme of the game. A portion of target 14 is left unpainted and, therefore, transparent or semi-transparent to allow frequency encoded light beam 68 from target light beam gun 18 to pass through transparent or semi-transparent front panel 22.

Behind the transparent portion of each target 14 is a target cylinder 24 attached to target back support panel 26.

Figure 3:
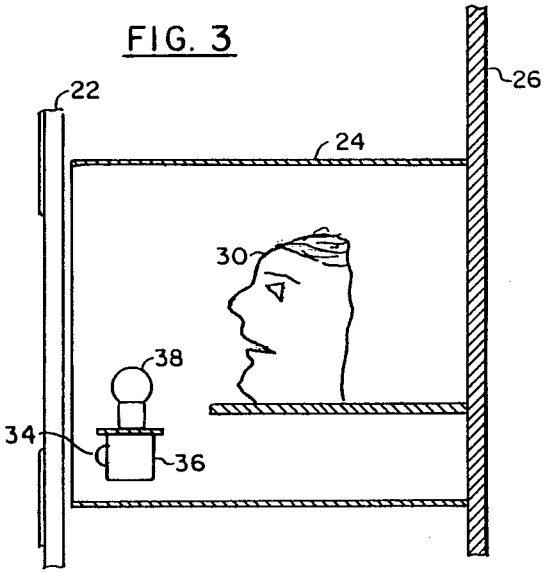
FIG. 3 is a side cross-sectional elevational view of the typical target taken at lines 3—3 of FIG. 2.
Figure 2:
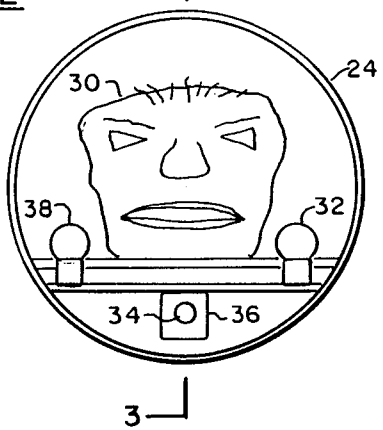
FIG. 2 is a front elevational view of a typical target used in the target shooting apparatus of FIG. 1.

Target cylinder 24 is shown in greater detail in FIGS. 2 and 3.

Each target cylinder 24 contains a target FIG. 30, first light source 32 used to illuminate target FIG. 30, a photodetector 34 with preamplifier 36 for detecting an infrared signal or a "hit" when activated by frequency encoded light beam 68 (FIG. 5) from any one of the light beam guns or rifles 18, and a second light source 38 used to indicate when the target has been "hit" by producing a lighting display simulating an explosion or other catastrophic event.

Because of the semi-transparent characteristics of front panel 22, when front panel 22 is front lighted, target FIG. 30 is not visible. When back lighted or lighted from within target cylinder 24 by light source 32, target FIG. 30 then becomes visible.

Figure 4:
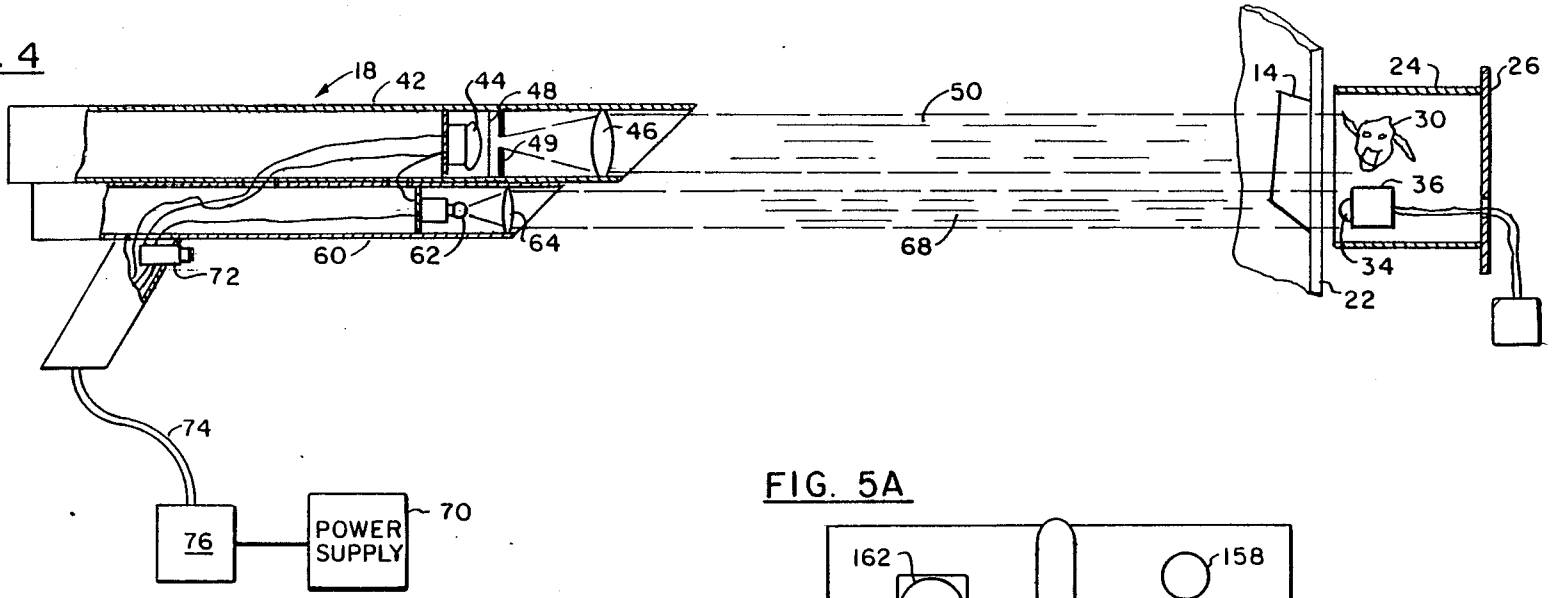
FIG. 4 is a partial cut-away view of the typical light beam emitting gun or rifle of the present invention and its functional relationship to a typical target.

With reference to FIG. 4 there is illustrated an elevational cross-section of a typical light beam gun or rifle 18 firing at a typical target 14 attached to target back support panel 26 and mounted immediately behind transparent or semitransparent front panel 22.

Light beam gun 18 comprises, basically, a first cylindrical barrel 42 containing a first or aiming light source 44 and collimating lens 46 for focusing the light from light source 44 into light beam 50. Aperture plate 49 is use to define the shape of light beam 50.

Between light source 44 and lens 46 is a color filter 48 and an aperture plate 49.

First or aiming light source 44 can be any electromagnetic radiating source producing electromagnetic radiation visible to the human eye. Typically this can be a krypton light source, a coherent or laser light source or any incandescent light source.

Light beam gun 18 further comprises a second cylindrical barrel 60 containing a second or frequency encoded light source 62 and collimating lens 64 for focusing the light from light source 62 into a frequency encoded light beam 68.

Second or frequency encoded light source 62 can be any electromagnetic radiating source producing radiation invisible to the human eye. Typically this can be an infrared light source such as an infrared light emitting diode.

First light source 44 is electrically connected to power source 70 through trigger 72 and control cable 74.

Trigger 72 can typically comprise a double pole, spring loaded, momentary contact pushbutton type of switch connected either directly to the respective light sources 44 and 62 or connected to a pulsed power source in frequency generator 76.

Second or frequency encoded light source 62 is connected to frequency generator 76 also through trigger 72 and control cable 74.

Frequency generator 76 comprises, basically, two frequency generators, common in the art, adapted to provide either a continuous signal or a frequency signal having a finite time duration, 0.5 seconds, for example, when trigger 72 is pressed.

For the light gun of the present embodiment, frequency generator 76 is adapted to generate, simultaneously, a combination of two out of eight predetermined frequencies for each light beam emitting gun.

By using eight different frequencies in combinations of two frequencies each, a total of 36 unique sets of frequency combinations are created thus permitting up to 36 light beam guns to be separately identified by a unique frequency combination.

Frequency generator 76 can also be a pulse modulated signal generator common in the art.

Where two light beams are illustrated in FIG. 4, a visible one 50 for aiming and an invisible one 68 for transmitting the frequency encoded information, it is also feasible to use only one visible light beam that is also frequency encoded, for example, a frequency encoded laser beam or gaseous discharge light source. Other means for encoding a steady state light beam can also be used, such as, a liquid crystal shutter or Kerr cell.

Figure 5A:
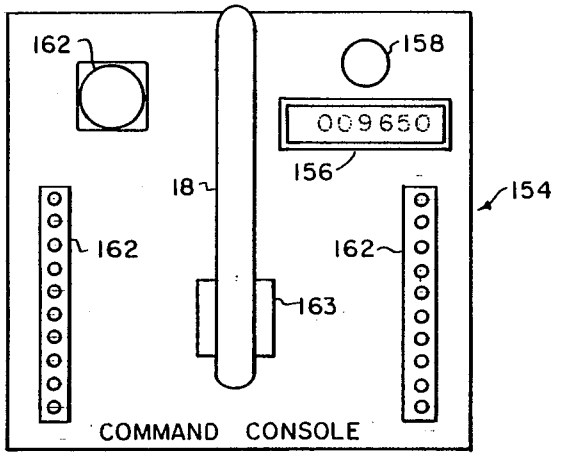
FIG. 5A is a plan view of a typical gun control console at each player's station.
Figure 5:
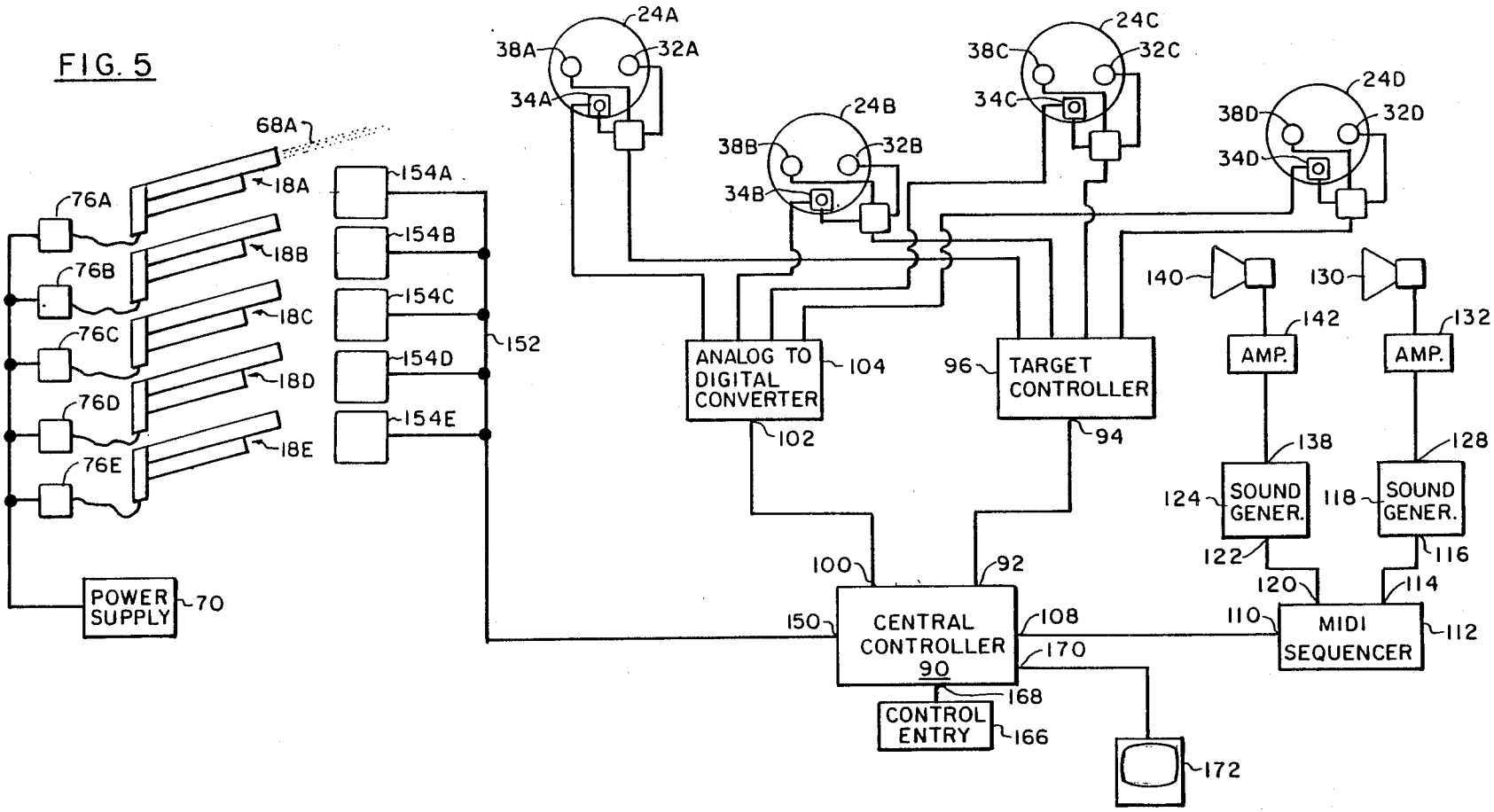
FIG. 5 is a schematic diagram of the electronic elements and their relationship to the mechanical elements of the target shooting apparatus of FIGS. 1, 2, 3, and 4.

With reference to FIG. 5 there is illustrated a schematic diagram showing the system for controlling the target shooting apparatus of the present invention in which 4 targets 14 (14A through 14D) and 5 light beam guns 18 (18A through 18E) are used.

Figure 6:
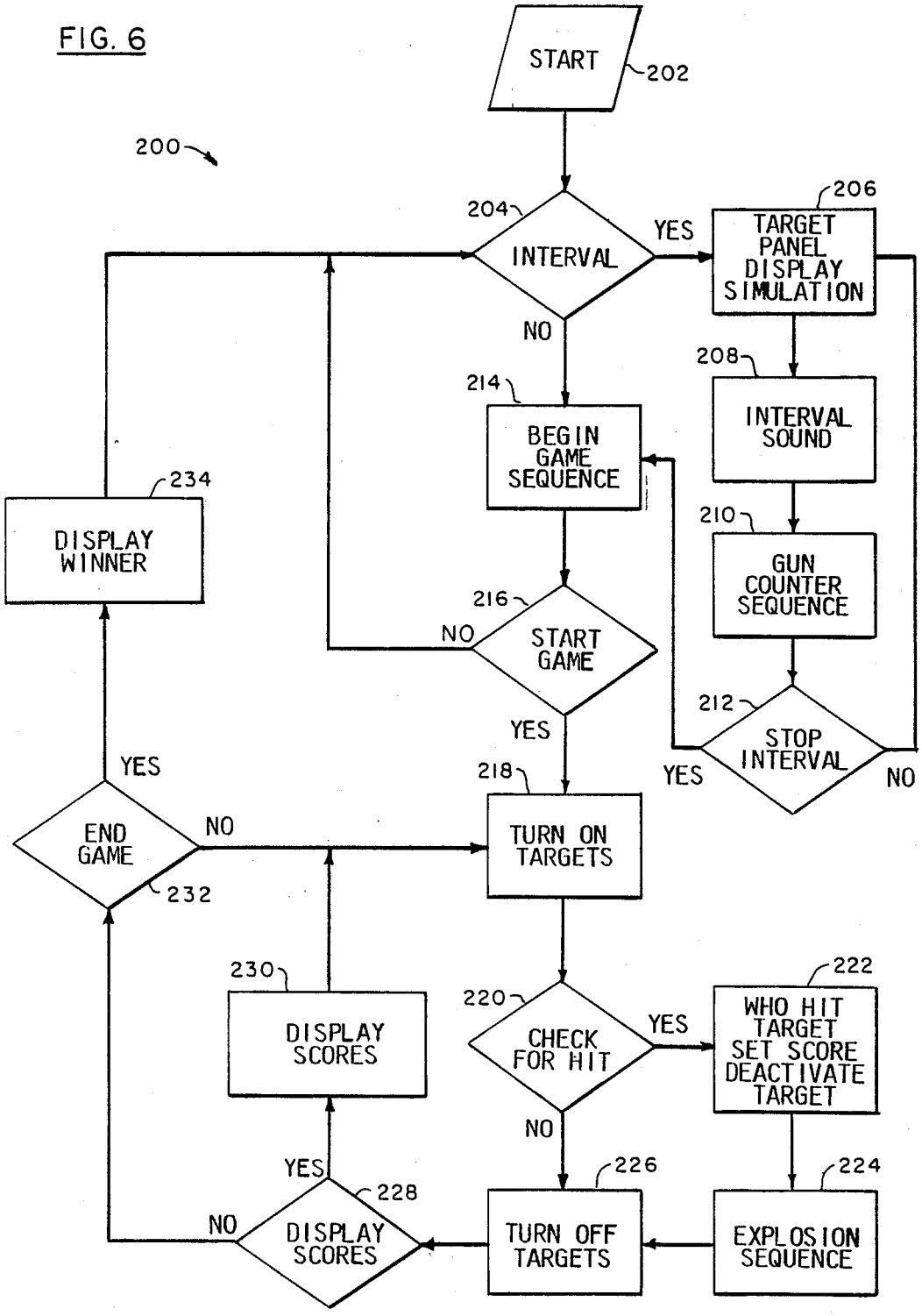
FIG. 6 is a flow chart of the steps used to activate and deactivate the various electrical elements of the target shooting apparatus of FIGS. 1, 2, 3, and 4.

The heart of the target shooting apparatus 10 of the present invention comprises, basically, a central controller 90 which can be a general purpose computer or a special computer adapted to perform the functions shown in the flow chart 200 of FIG. 6.

To perform those various functions noted in the flow chart 200 of FIG. 6, particularly those function controlling the status of targets 14A through 14D, output port 92 of central controller 90 is electrically connected to input port 94 of target controller 96.

Target controller 96, in turn, is adapted to control the on/off status of the various functional elements of each target, namely, target first light source 32, target second light source 38 and photodetector 34.

It should be noted that the output signal from central controller 90 to target controller 96 is digital in order to control the various latches and transistor drivers needed to activate and deactivate the target components. Such latches and transistor drivers are well known and common in the art and being such, are not shown in greater detail.

To receive the information regarding target "hits" and the identity of the light beam gun making the "hit", central controller 90 is connected, at input port 100, to output port 102 of analog-to-digital converter or frequency encoded beam decoder 104.

Analog-to-digital converter or frequency encoded beam decoder 104 functions to convert the amplitude or pulse modulated analog signal detected and transmitted by photodetector 34 into the digital signal identifying or representing the particular frequency combination for a particular light beam gun 18. This digital signal is received and processed by central controller 90 to calculate a score of the player using the particular light beam gun and activate the target "hit" sequence of steps shown in the flow chart 200 of FIG. 6 and as further describe below.

To generate the tone or sound effects used during the operation of the target shooting apparatus, output port 108 of central controller 90 is electrically connected to input port 110 of musical instrument digital information (MIDI) sequencer 112.

MIDI sequencer 112 is pre-programmed to cause background tone or sound generator 118 and explosion tone or sound generator 124 to create a tone or sound effect appropriate to the art work theme of the target panel and the event being depicted.

To create a background tone or sound effect, output port 114 of MIDI sequencer 112 is electrically connected to input port 116 of background tone or sound generator 118. To create a "hit" tone or sound effect, output port 120 of MIDI sequencer 112 is electrically connected to input port 122 of explosion tone or sound generator 124.

The output from background tone or sound generator 118 is transmitted to background loudspeaker 130 from output port 128 through amplifier 132.

The output from explosion tone or sound generator 124 is transmitted to explosion loudspeaker 140 from output port 138 through amplifier 142.

As the game progresses, scores for each light beam gun 18 are generated by central controller 90 and transmitted from output port 150 to each gun control console 154A, 154B, 154C, 154D, and 154E.

A typical gun control console 154 is shown in FIG. 5A and comprises, basically, an individual score light emitting diode (LED) display 156, a "hit" light 158, an LED staircase sequence display 160 and a gun speaker 162.

Each gun control console 154 (154A through 154E) is electrically connected to output port 150 of central control 90 by a common bus 152. Score display 156, hit light 158, LED staircase sequence display 160 and gun speaker 162 for each gun control console 154 are adapted to be activated only upon the particular unique signal from central controller 90 addressed to that specific gun control console 154 (154A through 154E).

Upon receiving a pulse from central controller 90 indicating a "hit", the score on individual score display 156 is incremented to indicate a total score, enables or activates each LED in LED staircase sequence display 160 and enables or activates "hit" light 158 for approximately ½ second. Gun speaker 162 is caused to produce a sound effect simulating a gun or other shooting device each time trigger 72 of light beam gun 18 is pressed for the gun corresponding to that particular gun control console.

To input start and stop instructions as well as request status of the system, control entry keyboard 166 is connected to input port 168 of central controller 90. Information important to the operation of the system is then transmitted from output port 170 to system monitor terminal 172.

Operation:

To operate the target shooting apparatus 10 of the present invention, reference must be made to FIG. 6 in which flow chart 200 illustrates the various operating sequences of the target shooting apparatus of the present invention that comes within the control of central controller 90.

Using control entry keyboard 160, central controller 90 is first activated to its pre-game status (steps 202 and 204). Upon entering the command to start the pre-game sequence target first light sources 32 in target panel display 12 are actuated at step 206, background tone or sound generator 118 is also actuated to produce the background "theme" tone or sound effects at step 208, and score light display 156 and LED staircase display 160 are actuated to set the scores on gun control consoles 154A through 154E to "0" at step 210. As long as there is a "NO" decision at step 204, this sequence will repeat itself.

Upon entry of a "YES" decision using a "start" button or other key or key sequence at controller entry keyboard 166 (FIG. 5) to start a game, the "begin game sequence" step will be activated at step 214.

Preferably, a number of selected targets 14 will be turned on. Targets not immediately turned on will be turned on later when the earlier selected targets have been "hit". This includes energizing target first light sources 32A through 32D and photodetectors 34A through 34D through target controller 96 (FIG. 5).

The players operating various light beam guns 18 (up to 5 players in the apparatus shown in FIG. 5) will then start firing at the various targets at which time central controller 90 will be checking for hits at step 220 of flow chart 200.

When a "hit" is detected by any photodetector 34A through 34D, such as photodetector 34A of FIG. 5, the analog frequency encoded signal is transmitted to analog-to-digital converter or decoder 104 where it is converted into a digital signal unique to the particular light beam gun 18, say, for example, gun 18A. This digital signal is decoded by central controller 90, at step 222 of flow chart 200, at which time it determines which gun hit the target, then allocates a score for that particular gun and then issues an instruction to target controller 96 to turn photodetector 34A off and to turn target first light source off. At step 224 central controller 90 then issues an instruction to target controller 96 to activate target second light source 38A to flash or otherwise simulate an explosion or other catastrophic event while simultaneously instructing MIDI sequencer 112 to issue an instruction to explosion sound generator 124 to generate a sound effect simulating an explosion or other sound effect depicting a catastrophic event. When this occurs, another target is immediately turned on.

At step 226, central controller 90 issues an instruction to target controller 96 to turn off all targets that have been on for a predetermined period of time and turned on those targets that have been previously turned off.

If the game is not over as determined at step 228, an instruction is issued at step 230 to display all scores on each player's gun control console 154A through 154E after which all targets are turned back on or reactivated at step 220 and target shooting sequence is repeated.

When the decision is made at step 228 to not display the scores, the decision must then be made by controller 90 at step 232 whether to end the game. This is achieved by the operator initially establishing a time limit for each game after which central controller 90 ends the game at the time limit set by the operator.

If the instruction decision is "NO" the target shooting sequence will be repeated starting at step 218. If the instruction decision is "YES", central controller 90, at step 234, will determine the winner and display the light beam gun number or the top players on monitor 172 or other display lights on target panel 12.

Central controller 90 will then revert to the pre-game sequencing from step 204 to steps 206, 208, 210 and 212 until the operator, using a start button or other designated key or keys on control entry keyboard 166, instructs central controller 90 to start another game.

We claim:

1. A target shooting apparatus comprising a plurality of rifles, each rifle comprising means for generating a beam of light having a wavelength generally visible to the human eye, means for frequency encoding said beam of light comprising means for pulse modulating said beam of light using a combination of at least two different frequencies, a plurality of targets, each target comprising
means for detecting said frequency encoded beam of light,
a target first light source adapted to illuminate said target,
a target second light source adapted to indicate when a frequency encoded beam of light has been detected by said means for detecting said frequency encoded beam of light,
a central controller comprising
means for activating said plurality of target first light sources,
means for activating said means for detecting said frequency encoded beam of light,
means for deactivating said target first light source, actuating said target second light source, decoding said frequency encoded beam of light to obtain a decoded signal, deactivating said means for detecting said frequency encoded beam of light, and allocating a score to the rifle represented by the decoded signal of said frequency encoded beam of light when said means for detecting said frequency encoded beam of light detects a frequency encoded beam of light.

2. A target shooting apparatus comprising
a plurality of rifles, each rifle comprising
means for generating a beam of light having a wavelength generally visible to the human eye,
means for frequency encoding said beam of light comprising
means for amplitude modulating said beam of light using a combination of at least two different frequencies,
a plurality of targets, each target comprising
means for detecting said frequency encoded beam of light,
a target first light source adapted to illuminate said target,
a target second light source adapted to indicate when a frequency encoded beam of light has been detected by said means for detecting said frequency encoded beam of light,
a central controller comprising
means for activating said plurality of target first light sources,
means for activating said means for detecting said frequency encoded beam of light,
means for deactivating said target first light source, actuating said target second light source, decoding said frequency encoded beam of light to obtain a decoded signal, deactivating said means for detecting said frequency encoded beam of light, and allocating a score to the rifle represented by the decoded signal of said frequency encoded beam of light when said means for detecting said frequency encoded beam of light detects a frequency encoded beam of light.

3. A target shooting apparatus comprising
a plurality of rifles, each rifle comprising
means for generating a first beam of light having a wavelength generally visible to the human eye,
means for generating a second beam of light having a wavelength generally invisible to the human eye,
means for frequency encoding said second beam of light,
a plurality of targets, each target comprising
means for detecting said frequency encoded second beam of light,
a target first light source adapted to illuminate said target,
a target second light source adapted to indicate when a frequency encoded second beam of light has been detected by said means for detecting said frequency encoded beam of light,
means for activating said plurality of target first light sources and said means for detecting said frequency encoded second beam of light,
means for simultaneously deactivating said target first light source, actuating said target second light source, decoding said frequency encoded second beam of light to obtain a decoded signal, deactivating said means for detecting said frequency encoded second beam of light, and allocating a score to the rifle represented by the decoded signal of said frequency encoded second beam of light when said means for detecting said frequency encoded second beam of light detects a frequency encoded beam of light,
means for reactivating said target first light source and detectors.

4. The target shooting apparatus as claimed in claim 3 wherein said means for simultaneously deactivating said target first light source, actuating said target second light source, decoding said frequency encoded second beam of light to obtain a decoded signal, deactivating said means for detecting said frequency encoded second beam of light, and allocating a score to the rifle represented by the decoded signal of said frequency encoded second beam of light when said means for detecting said frequency encoded second beam of light detects a frequency encoded second beam of light, further comprises
means for simultaneously actuating a first sound effects display.

5. The target shooting apparatus as claimed in claim 3 wherein said means for frequency encoding said second beam of light comprises
means for amplitude modulating said second beam of light using a combination of at least two different frequencies.

6. The target shooting apparatus as claimed in claim 3 further comprising
means for creating a background sound effects display during activation of target shooting apparatus.

7. The target shooting apparatus as claimed in claim 3 wherein said means for frequency encoding said second beam of light comprises
means for pulse modulating said second beam of light using a combination of at least two different frequencies.

* * * * *